US011525323B2

(12) United States Patent
Semlinger et al.

(10) Patent No.: US 11,525,323 B2
(45) Date of Patent: Dec. 13, 2022

(54) STUFFING BOX ENVIRONMENTAL SEAL

(71) Applicant: AWA Oilfield Services, Inc., Houston, TX (US)

(72) Inventors: Kyle Semlinger, Poth, TX (US); Harold E Armstrong, Houston, TX (US)

(73) Assignee: AWA Oilfield Services, Inc., Houston, TX (US)

( * ) Notice: Subject to any disclaimer, the term of this patent is extended or adjusted under 35 U.S.C. 154(b) by 0 days.

(21) Appl. No.: 17/095,189

(22) Filed: Nov. 11, 2020

(65) Prior Publication Data

US 2022/0145719 A1 May 12, 2022

(51) Int. Cl.
*E21B 33/08* (2006.01)
*E21B 33/03* (2006.01)
*E21B 43/12* (2006.01)

(52) U.S. Cl.
CPC ..... *E21B 33/03* (2013.01); *E21B 33/08* (2013.01); *E21B 43/127* (2013.01)

(58) Field of Classification Search
CPC ..... E21B 33/03; E21B 33/08; E21B 43/127
See application file for complete search history.

(56) References Cited

U.S. PATENT DOCUMENTS 2,994,549 A * 8/1961 Tschappat ..... F16J 15/20 277/329
3,002,776 A * 10/1961 Tschappat ..... E21B 33/08 277/529
4,560,176 A * 12/1985 Hoff ..... F16J 15/184 277/505
5,246,067 A 9/1993 Heinonen et al.
5,540,283 A 7/1996 Hahn
6,000,469 A * 12/1999 Bassinger ..... E21B 33/08 166/241.1
6,637,509 B2 * 10/2003 Farquharson ..... E21B 33/08 166/241.2
2005/0103505 A1 * 5/2005 Lappin ..... F16J 15/20 166/387
2017/0241240 A1 8/2017 Lang et al.

OTHER PUBLICATIONS

R&M Energy Systems, Inc., Hercules(r) General Products, 2011, U.S.A.
Nov Completion & Production Solutions, Stuffing Boxes, 2018, Internet.

* cited by examiner

*Primary Examiner* — Taras P Bemko
(74) *Attorney, Agent, or Firm* — McAughan Deaver PLLC

(57) ABSTRACT

An annular seal configured to prevent fluid from outside the wellbore from entering a well head stuffing box and tripping an anti-pollution control device. The seal comprising an elastomeric material and having a seam configured to allow the seal to installed on or in a stuffing box without dismantling well-head equipment.

20 Claims, 9 Drawing Sheets

STUFFING BOX ENVIRONMENTAL SEAL

CROSS REFERENCE TO RELATED APPLICATIONS

None.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The present invention relates to stuffing boxes for polished rods associated with oil field pump jack oil wells, and more specifically to an environmental seal configured to prevent external fluids from interfering with the pump jack operation.

Description of the Related Art

U.S. Pat. No. 5,246,067 is entitled Well Leak Catcher and discloses: "A leak catcher for use on a pumping well around a polished rod operating a downhole pump in the well including an annular drip bowl connected with a base securable to the upper end of a well casing around a polished rod, a drain line fitting opening into a side of the drip bowl, a leak collection well formed in the bottom of the drip bowl, a horizontal liquid level switch mounted to a side of the liquid collection well, a drain valve mounted horizontally through a side of the liquid collection well, a removable hood securable to the drip bowl, and a polished rod lubricator assembly secured in the top of the hood around a polished rod. The hood may be either a solid cylindrical member formed of opaque metal or transparent plastic or may include hinged doors for access into the leak catcher without removal of the hood. The leak catcher is constructed in the modular form so that the drip bowl with the liquid level switch and drain fittings may be used alone or in conjunction with the hood and lubricator assembly. The catcher may also include a stuffing box with a remotely controllable emergency seal assembly and a flapper valve for closing the bore through the leak catcher if a polished rod through the catcher breaks."

U.S. Pat. No. 5,540,283 is entitled Well Pumping and discloses: "A method and apparatus for protecting a polished rod of a pumping unit so that the portion of the polished rod that passes out of the top of a stuffing box of a wellhead on the upstroke of the polished rod is protected from the environment surrounding the wellhead. The method and apparatus also assist with containment of well fluids which may escape from the stuffing box."

U.S. Pat. No. 6,637,509 is entitled Wellhead Stuffing Box Support Assembly and discloses: "A stuffing box support assembly is configured to be positioned between a production pumping tree and a stuffing box of a wellhead. In use, the support assembly functions like a joint between the wellhead production tree and the stuffing box. The support assembly is configured such that it could tilt or move laterally to maintain a coaxial relationship between the stuffing box and a polished rod extending therethrough. This alignment between the stuffing box and the polished rod reduces wear and tear of the stuffing box packing."

U.S. Patent Application Publication 2017/0241240 is entitled Rainguard for Oil Well Trapper Box and discloses: "A rainguard device for insertion on top of a stuffing box containment basin, said device comprises: a top portion; a shield; and a base ring; wherein said top portion comprising a flat circular upper section connected at its underside to a neck connected to a lower section; said neck is adapted to be inserted into an aperture present at a top section of the shield; said top portion having a vertical central aperture going therethrough adapted to receive a polish rod; said shield comprising two halves and having a frusto-conical top portion and defining an aperture at the top thereof and having a cylindrical bottom section; said bottom section defining an aperture and adapted to be inserted into the base ring; said base ring comprising two halves each of which comprising: a lower edge adapted for insertion into the inside of said basin; a middle ring portion supporting an inner lip and an outer lip, both inner and outer lips extending updwardly from the middle ring portion and both lips extending around the circumference of the middle ring portion; said inner lip and outer lip defining therebetween a channel adapted to receive an edge of the bottom portion of the shield; and wherein the base ring is adapted to rest on a top edge of the stuffing box containment basin."

The inventions disclosed herein are directed to an improved environmental seal for stuffing boxes.

BRIEF SUMMARY OF THE INVENTION

As a non-limiting summary of our inventions, we have invented a seal element for a stuffing box that may comprise an elongated toroid made of an elastically deformable material having an inside, an outside, a thickness, and a length. The outside of the elongated toroid may be configured with at least one lip extending radially from the elongated toroid for at least a portion of the length of the elongated toroid. The lip may be configured to be releasably retained against a surface of a stuffing box. The elongated toroid may be configured with a slit through the thickness of the elongated toroid along its length. The slit may have a first face and a second face, and a surface of a portion of the inside of the elongated toroid may be configured to form a seal with at least a portion of a cylindrical shaft along the length of the elongated toroid when the first face of the slit abuts the second face of the slit.

A portion of the outside of the elongated toroid configured to form a seal with at least a portion of an annular surface of the stuffing box. The lip may be disposed adjacent to a first end of the elongated toroid. The lip may be disposed between a first end and a second end of the elongated toroid. The lip is further configured to be releasably retained against a second surface. The second surface may be a surface of the stuffing box apart from the first surface. The second surface is secured to the stuffing box. The second surface may be secured to the stuffing box with threaded members. The cylindrical shaft may be configured for reciprocating motion.

A stuffing box seal may comprise a body having an inside, an outside, an inside diameter, an outside diameter, and a length. The outside of the body may be configured with at least one radially projecting lip. The at least one radially projecting lip may have an upper surface and a lower surface and wherein the upper surface and lower surface may be configured to meet annular surfaces of a stuffing box to constrain movement of the stuffing box seal relative to the stuffing box. The seal may comprise a separation in the body from at least the inside diameter to the outside diameter along the length of the body. The separation may have a first face and a second face wherein each face may comprise a surface extending radially from at least the inside diameter to the outside diameter of the body along at least a portion of the length of the body from the lower surface of the lip to the upper surface of the lip. The body may be operable to be opened along the separation for at least a portion of the length of the body such that the first face of the separation is at a distance at least equal to the inside diameter of the body away from the second face of the separation. At least a portion of the inside of the body may be configured to form a seal with a shaft having a diameter substantially the same as the inside diameter of the body.

At least a portion of the outside of the body may be configured to form a seal with an annular surface of the stuffing box having an inside diameter substantially the same as the outside diameter of the body. The lip may be disposed adjacent to a first end of the cylinder. The lip may be disposed between the first end and a second end of the cylinder. The lip may be further configured to be releasably retained against a second surface. The second surface may be a surface of the stuffing box apart from the first surface. The second surface may be secured to the stuffing box. The second surface may be secured to the stuffing box with threaded members. The shaft may be configured for reciprocating motion.

A method for installing a sealing element on a stuffing box may comprise providing a sealing element comprising a body made of an elastically deformable material having an inside, an outside, a thickness, and a length. The outside of the body of the sealing element may be configured with at least one lip extending radially from the outside of the body for at least a portion of the length of the body. The lip may comprise at least one surface normal to a central axis of the body. The body further may be configured with a seam through the thickness of the body along its length, and wherein the seam may have a first face and a second face. The inside of the body of the sealing element may be configured to encompass at least a portion of the shaft along the length of the elongated cylinder. Opening at least a portion of the seam to a width of at least the diameter of the shaft. Placing the open portion of the seam on the shaft and moving the body towards the shaft until the length of the inside of the body opposite the seam touches the shaft. Closing the seam, and axially moving the body along the shaft until the surface of the lip contacts a surface of the stuffing box. Removing and replacing the stuffing box cap.

None of these brief summaries of the inventions is intended to limit or otherwise affect the scope of the appended claims, and nothing stated in this Brief Summary of the Invention is intended as a definition of a claim term or phrase or as a disavowal or disclaimer of claim scope.

BRIEF DESCRIPTION OF THE SEVERAL VIEWS OF THE DRAWINGS

The following figures form part of the present specification and are included to demonstrate further certain aspects of the present invention. The invention may be better understood by reference to one or more of these figures in combination with the detailed description of specific embodiments presented herein.

Figure 1:
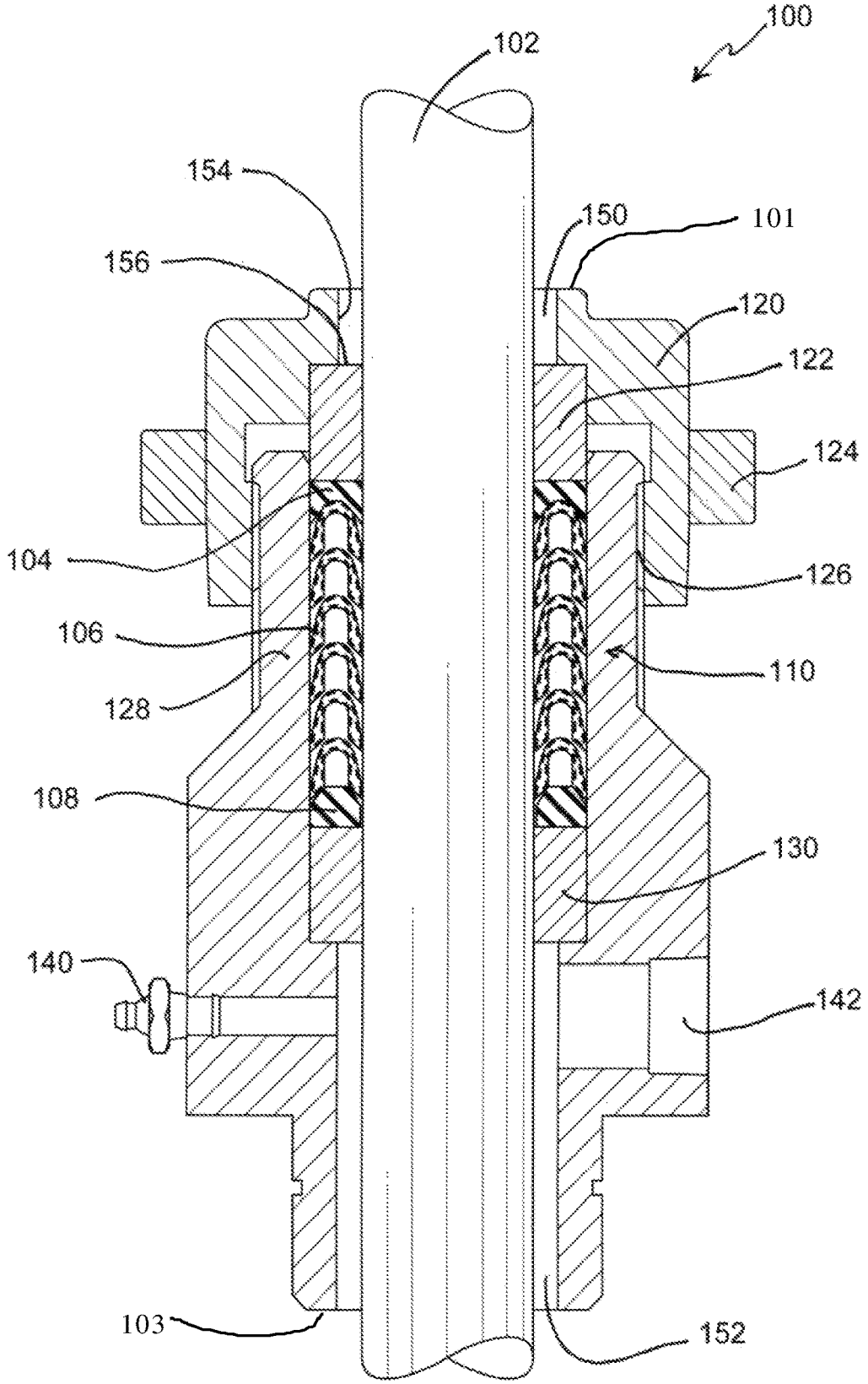
FIG. 1 (Prior Art)
FIG. 1 illustrates a typical prior art stuffing box.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above, and the written description of specific structures and functions below are not presented to limit the scope of what we have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Reference throughout this disclosure to "one embodiment," "an embodiment," or similar language means that a particular feature, structure, or characteristic described in connection with the embodiment is included in at least one of the many possible embodiments of the present inventions.

The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of one embodiment may be combined in any suitable manner in one or more other embodiments. Those of skill in the art having the benefit of this disclosure will understand that the inventions may be practiced without one or more of the specific details, or with other methods, components, materials, and so forth. In other instances, well-known structures, materials, or operations are not shown or described in detail to avoid obscuring aspects of the disclosure. The disclosure and teachings provided herein with respect to one or more figures or embodiments equally well to other figures or embodiments discussed herein as well as to later-developed embodiments of the inventions. Persons of skill in this art will appreciate that aspects, components, and/or functionalities of the disclosed embodiments may be mixed, matched, and/or interchanged to create other embodiments without deviating from the inventions disclosed and enabled herein. The various methods and embodiments of the methods of manufacture and assembly of the system, as well as location specifications, can be included in combination with each other to produce variations of the disclosed methods and embodiments. Discussion of singular elements can include plural elements and vice-versa. The embodiments described by the appended claims are hereby incorporated into this detailed description of embodiments.

The description of elements in each Figure may refer to elements of proceeding Figures. Like numbers refer to like elements in all figures, including alternate embodiments of like elements. In some possible embodiments, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

In general terms, we have invented apparatuses and methods that may be applied to prevent external fluids such as, but not limited to, rain, mist, condensate, and particulate matter from entering the stuffing box from outside the well bore.

FIG. 1 illustrates a cross-section view of a typical, prior art stuffing box 100 having a top surface 101 and bottom surface 103 with a pollution control feature. The polished rod 102 is sealed within the stuffing box 100 by a seal pack 110. Seal pack 110 may be composed of individual seal elements 106 and bound on the top by an upper seal pack adapter 104, and on the bottom by a lower seal pack adapter 108. The seal pack 110 may be constrained on the top by an upper packing bushing 122, on the bottom by lower packing bushing 130, and circumferentially by the stuffing box body 128. Typically, a stuffing box cap 120 may be tightened onto the stuffing box body 128 with threads 126 or other means known to those of ordinary skill in this art.

Continued tightening of the stuffing box cap 120 onto the stuffing box body 128 will force the upper packing bushing 122 towards the lower packing bushing 130. This will compress the seal pack 110 to form a fluid seal around the polished rod 102. Seal elements 106 are usually configured and disposed to provide a more effective seal against well fluids moving upwards through the stuffing box 100 rather than against fluids, such as rain moving downwards through the stuffing box 100.

Stuffing box 100 also may have an outlet 142, which also may be referred to as an anti-pollution or environmental outlet. It will be appreciated that in most, if not all, well systems, the outlet for production of well fluids (not shown), such as oil and gas, is located below the stuffing box 100. Thus, any well fluids that leak upward past the production outlet may exit the anti-pollution outlet 142 and may be collected by an anti-pollution adapter control device (not shown). In effect, this control device may be a bucket with a fluid level transducer operatively coupled thereto. If enough fluid (e.g., well fluid) is collected by the control device, the pump jack may be de-energized to prevent a stuffing box "spill" of well fluids into the environment.

It has been found that other external fluids such as rain or water condensation on the polished rod 102 may accumulate in annulus 150 around the polished rod 102. Under certain conditions, the reciprocating motion of the polished rod 102 may move some or all of that fluid past the seal pack 110 into the lower annulus 152 where the fluid may be expelled through pollution collection outlet 142. If sufficient fluid has been moved or leaked through the stuffing box 110 into the pollution outlet 142, the pollution control device may activate to stop pump jack operations. In other words, the pump jack is stopped for reasons other than well fluid leaking out the pollution outlet 142. This is an undesirable result and costs the well operator time and money.

While this may happen in newly installed pumpjacks, we have seen this more often in older units where there may be some scoring or abrasion on the polished rod 102, or some looseness on the upper and lower packing bushings 122 130, which may not be easily remedied by further tightening of the stuffing box cap 120. Among other reasons, the expense and associated downtime generally dissuade unit operators from disassembling the wellhead to correct any small leaks. However, the potential for intermittent downtime and unexpected loss of production is an incentive for unit operators to remedy this issue.

Those of skill in the art having benefit of this disclosure will understand that the inventions disclosed and taught herein are not limited for use with the specific stuffing box illustrated in the figures and that the inventions may be implemented and practiced in many embodiments for a wide variety of stuffing boxes. Also, while the inventions disclosed and taught herein are effective in use while the pumpjack is operating and thus the polished rod 102 is reciprocating within the stuffing box 100, the inventions are also effective while the polished rod 102 is stationary in the stuffing box 100.

Figure 2:
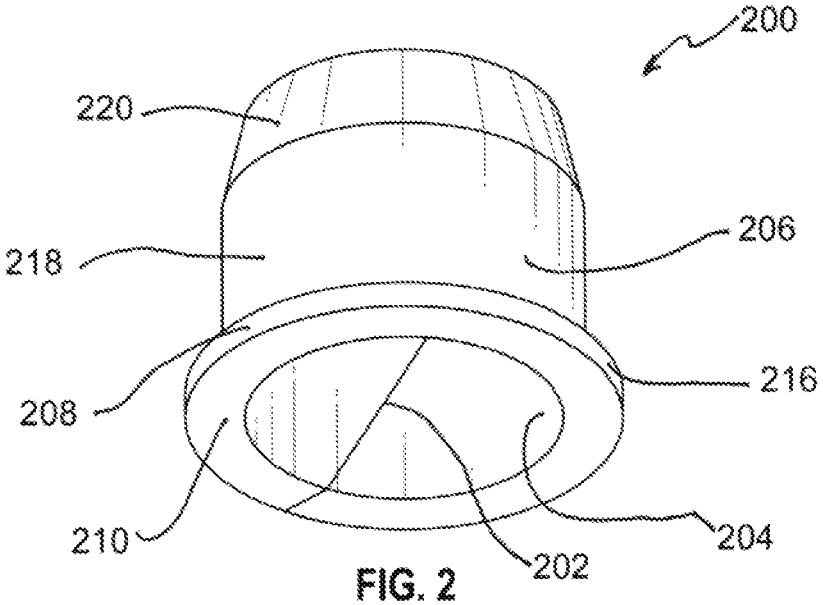
FIGS. 2, 3 and 4 illustrate a first embodiment of an environmental seal according to the present inventions.
Figure 3:
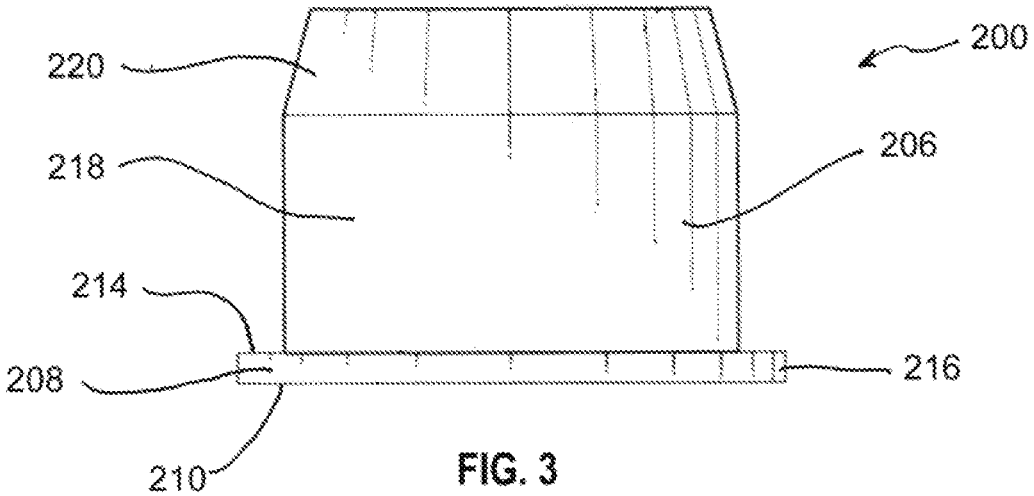

FIGS. 2-5 illustrate one of many possible embodiments of the inventions enabled herein. FIG. 2 illustrates a perspective view of an annular leak path seal 200. Seal 200 may be made of any number of materials that are durable in the environmental conditions normally associated with oilfield sites. These may include, but are not limited to rubber, vulcanized rubbers, elastomers, Buna-N, Nitrile, Nitrile butadiene rubber, EPDM, any polychloroprene, such as neoprene or other polymerized monomers and/or copolymers including butylene, isoprene, vinyl, propylene, siloxanes and many others known to those of skill in the art.

Annular leak path seal 200 preferably has an elongated body formed in the general shape of a tube, having an inner diameter surface and an outer diameter surface. At the bottom of the body may be a lip 208 having a lower lip surface 210, an edge 216, and an upper lip surface 214. Atop the lip 208 and, in this embodiment, and integral with or joined to it is a riser section 218. Atop the riser section 218 may be an optional taper section 220.

Running through the annular leak path seal 200 is an installation seam 202. The installation seam 202 may be at any angle relative to the axial direction of the body including vertical, in that the installation seam may be parallel to the direction of elongation of annular leak path seal 200. Those of skill in this art having benefit of this disclosure will appreciate that the installation seam allows the annular leak path seal 200 to be installed on a well system (e.g., about a polished rod) without removing the polished rod or otherwise dismantling the well head.

The installation seam 202 may be formed during manufacturing. Alternately, the installation seam 202 may be created after formation of the annular leak path seal 200 by slicing through the material from the outside 206 to the inside 204 without the loss of any material. Alternatively, the installation seam 202 may be formed by cutting through the annular leak path seal 200 whereby some material may be lost. Other methods of forming the installation seam 202 may be known to those ordinarily skilled in the art and used without deviating from the spirit of the inventions disclosed and taught herein.

Figure 4:
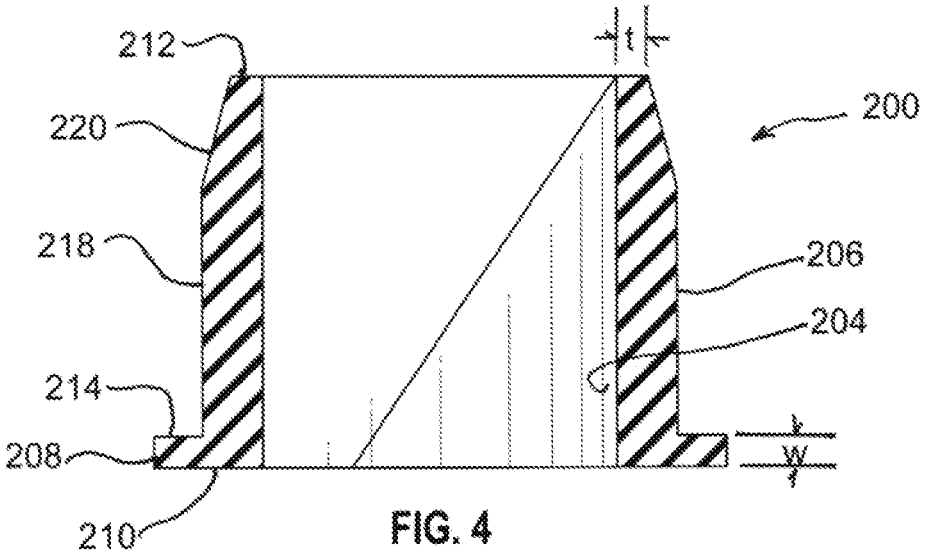

As illustrated in FIGS. 2-5, the installation seam 202 may be angled. When viewed from a cross-section of annular leak path seal 200, such as is illustrated in FIG. 4, the angle may be between about 20° to about 60° to the central or elongated axis, and preferably about 45°. As will be appreciated by those ordinarily skilled in the art, the illustrated installation seam 202 may present a section of a helical curve relative to the central axis of the body. Other linear or curvilinear sections may be used for the installation seam 202 without departing from the spirit of the inventions disclosed and taught herein.

It will be understood that the inner diameter of seal 200 may be sized based on the diameter of the polished rod 102, and therefore based on the size of the stuffing box 100. Depending on the elasticity of the material from which the seal 200 is made, the inner diameter may be less than the outer diameter of the polished rod 102, such as, for example, between about 90% and 100% of the polished rod diameter. For example, and not limitation, for a polished rod having a diameter of 1⅛ inches, the inner diameter of seal 200 may be between about 1 inch and about 1⅛ inch, and preferably between about 1 1/64 inch and 1 5/64 inch. The outer diameter of the seal 202 can be sized for the specific stuffing box cap 120 and corresponding upper annulus 154 diameter. Those of skill having benefit of this disclosure will appreciate the inner and outer diameters will be configured to provide a fluid tight seal for the upper annular leak path 150 of the particular stuffing box at issue.

Figure 5:
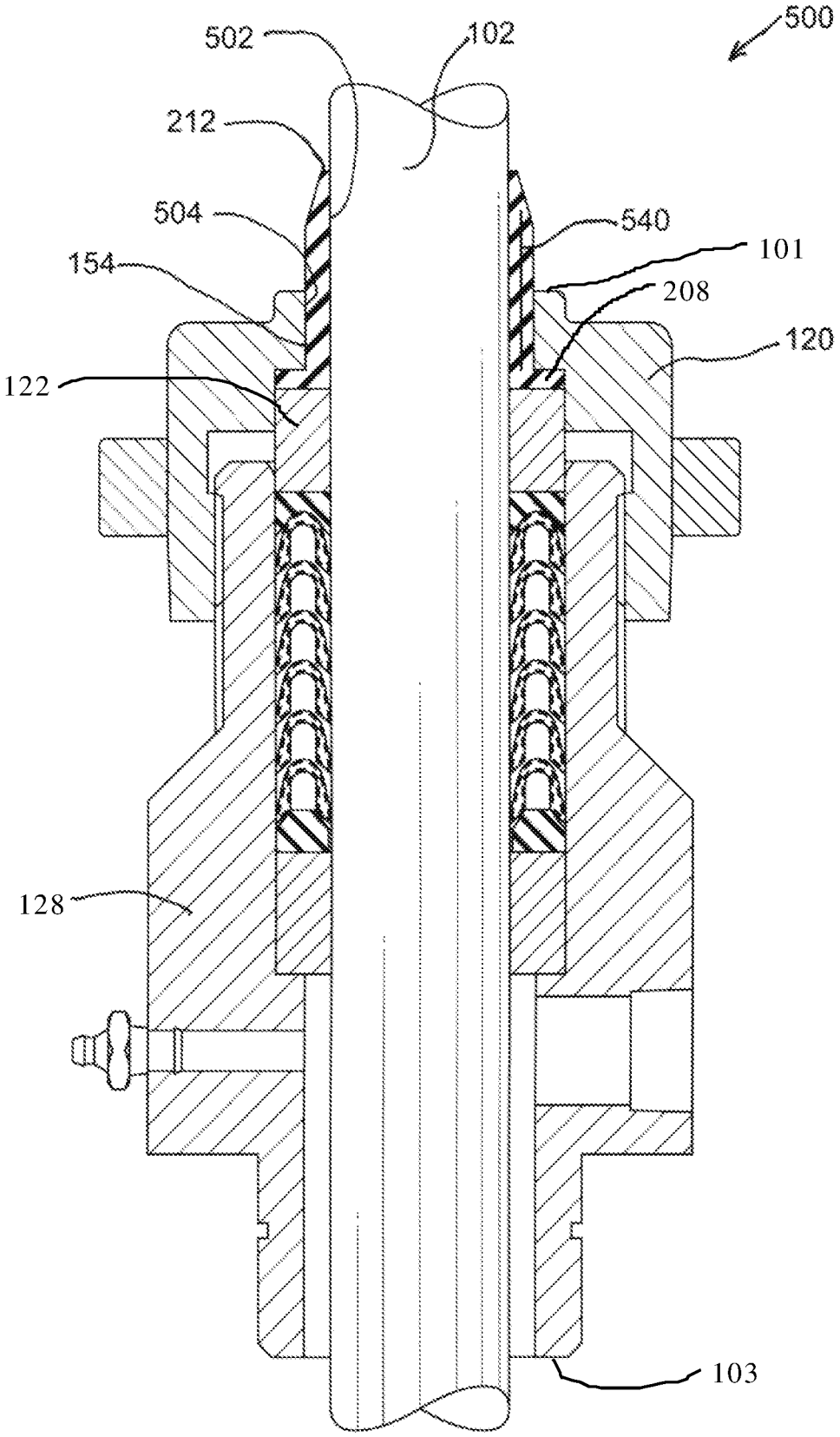
FIG. 5 illustrates a stuffing box with the environmental seal of FIG. 2.

FIG. 5 illustrates how the embodiment of the annular leak path seal 500 may be deployed with an exemplary stuffing box 100 having a top surface 101 and a bottom surface 103 and a body 128. Prior to installation, the pumpjack may be (but doesn't have to be) stopped so that the polished rod 102 is not moving. The stuffing box cap 120 may be loosened and raised upwards. The annular leak path seal 200 may be opened by opening installation seam 202 and installing the seal 200 around the polished rod 102. As discussed, the material used to form the seal body should be sufficiently pliable or flexible that the installation seam 202 may be separated far enough to go around the polished rod 102 without incurring any permanent damage (e.g., plastic deformation) to the seal 200 or 500.

One way of opening the annular leak path seal 200 is for an operator to grasp the end with the lip 208, and using the lip 208 as a handhold to separate the sides of the installation seam 202 to an extent that one end will start to slide over the polished rod 102. After the end has slid over the polished rod 102 to some extent and the polished rod 102 engaged to some portion of the inside surface 204 of the annular leak path seal 200, the operator may then be able to change handhold positions to another section of the outside 206 to further work the remainder of the annular leak path seal 200 over the polished rod 102. The natural bias of the material may be sufficient to bring the sides of the installation seam 202 back together. The operator may check to clear any debris that may be preventing the surfaces of the sides of the installation seam 202 from fully engaging with each other.

The operator also may check to ensure that the surfaces of the sides of the installation seam 202 are match, such as by visibly checking that the upper and lower lip surfaces 210, 214 are at the same elevations.

The annular leak path seal 200 may then be pressed downwards so that lower lip surface 210 engages the top of upper packing bushing 122. In this particular embodiment, lower lip surface 210 is configured to have inner and outer radial diameters substantially similar as those of the upper packing bushing 122. The stuffing box cap 120 may then be lowered into position and tightened to the stuffing box body 128.

In this installation, no contiguous cylindrical members are being added to the polished rod 102. That is to say that an unbroken ring cannot be installed over the polished rod 102 without disassembly of the pumpjack. Instead, an annular leak path seal 200 with installation seam is wrapped around the polished rod 102 and secured in place relative to the stuffing box 100. Therefore, disassembly of the pumpjack is avoided and downtime is kept to a minimum. It also will be appreciated that seal 200 may be installed around a reciprocating polished rod 102.

When deployed as is illustrated in FIG. 5, the annular leak path seal 200 may press tightly around the polished rod 102 to form an inner seal 502. The installation seam 202 may be pressed tightly together to prevent the formation of a channel that may transport fluids. While the installation seam 202 may be closed just by the pressure of the elastic bias of the material and the constraint provide by the cap 120, optionally, the seam 202 also may be treated with any number of substances that will further enhance the sealing and/or joining of the side surfaces of the installation seam 202. These substances may include, but are not limited to, glues, bonding agents, solvents, epoxies, or any other substance known to those ordinarily skilled in the art. In addition, depending on the material from which the seal 200 is made, thermal bonding, such as welding, may be used to seal and/or join the seam 200 after the seal 200 is placed around the polished rod 102.

If some closure or sealing treatment is used, it may be permanent or semipermanent. A semipermanent treatment may join the surfaces of the sides of the installation seam 202 together for some time, but then the surfaces may be separated later so that the seal 200 may be reused. On the other hand, a permanent treatment may bond the surfaces of the sides of installation seam 202 together in such a way that the seal 200 may only be removed by cutting it apart. In that way, the seal 202 may not be suitable for reuse.

The annular leak path seal 200 may also press tightly against the upper annulus surface 154 to form an outer seal 504. Having inner and outer seals 502, 504 will prevent external fluids such as rain, condensate, splashes of other fluids, and any particulate matter from entering the upper annulus and thus will prevent fluids and particles from traveling downwards any further into the stuffing box 100.

After installation of the annular leak path seal 200 into exemplary stuffing box 100, the pumpjack may be started (if it was stopped for installation) so that the polished rod 102 reciprocates within the seal 200. We have found that the top 212 of the annular leak path seal 200 may function as a wiper to remove fluids or debris, such as drops of water or condensate, from the polished rod 102 so that they do not enter the stuffing box 100.

In an exemplary deployment, the polished rod 102 should glide smoothly over the inner surface of the annular leak path seal 200 during its reciprocating motion. However, scoring, or other abrasions on the surface of the polished rod 102 may catch on the top 212 of the annular leak path seal 200 and may roll or otherwise distort or damage the seal.

In some conditions, polished rod 102 may retain a film of lubricant passed on to it from moving through the lubrication in the seal pack 110. This lubricant may be passed on to lubricate the inside 204 of annular leak path seal 200, which may reduce the propensity of the material to deform or roll while the polished rod 102 is moving through it.

If an optional taper section 220 is used in an exemplary annular leak path seal 200, a top 212 minimum thickness, shown as t in FIG. 4, may be used rather than letting the taper section 220 taper to a point. Having a minimum thickness t at the tapered end will ensure that the annular leak path seal 200 can maintain rigidity and affect a seal even when portions of annular leak path seal 200 are passing over rough, abraded, or dry spots on the polished rod 102.

FIG. 5 also illustrates the use of an optional seal reinforcement 540. Optional reinforcement 540 may be any number of objects embedded, installed, or otherwise disposed within or about the annular leak path seal 200. The optional reinforcement 540 may be configured to the strengthen the compression, buckling, or rolling, resistance of the seal 200, such as to minimize its ability to roll or collapse on a downstroke or extend on an upstroke. In one of many embodiments, optional reinforcement 540 may be one or more stiffening rods or plates molded within the body of annular leak path seal 200.

These stiffening rods or plates, or any other optional reinforcement structures need not go all the way through the body of annular leak path seal 200. For example, if annular leak path seal 200 is manufactured as a body and the installation seam 202 is cut through the body afterwards, it may be difficult to cut through the material with optional reinforcement structures in place. Therefore, optional reinforcement structures may be embedded in such a way that a cut to produce installation seam 202 does not go through any optional reinforcement structures. Of course, other embodiments may require a tool such as metal snips, to cut through the optional reinforcement to create the installation seam 202.

In another embodiment of a seal 200, optional reinforcement 540 may be a sheet of material cylindrically disposed within annular leak path seal 200. In yet another embodiment, optional reinforcement 540 may be a mesh cylindrically disposed within annular leak path seal 200. Other embodiments may be envisioned by those ordinarily skilled within this arts benefitting from the disclosures herein. For example, and not limitation, the optional reinforcement does not have to the internal or integral to the seal 202, but rather may be secured to the outside of the seal 202.

When polished rod 102 moves through the stuffing box 100 it slides against individual seal elements 106 of seal pack 110. The individual seal elements 106 may be lubricated from an external source, have inherent lubricity, or be lubricated by absorbing some of the produced fluids from the wellbore. If the pumpjack stops for some time, the lubrication in the seal pack 110 may dry out or evaporate if the top of the stuffing box 100 is left exposed to the ambient environmental conditions. However, as will be appreciated by those in possession of the inventions disclosed and taught herein, the seals formed by annular leak path seal 200 may prevent or reduce lubricants in the seal pack 110 from external exposure and may prevent or reduce them from drying out.

In the embodiment illustrated in FIG. 5 the annular leak path seal 200 is retained within stuffing box 100 by a compressive force exerted by the stuffing box cap 120 pressing on the upper lip surface 214 of annular leak path seal 200. We have found that a deformable material, such as neoprene, must have a minimum width, which is marked as w in FIG. 4, to ensure that the friction of the reciprocating motion of the polished rod 102 does not unseat, rend, or otherwise mutilate the annular leak path seal 200.

Figure 6:
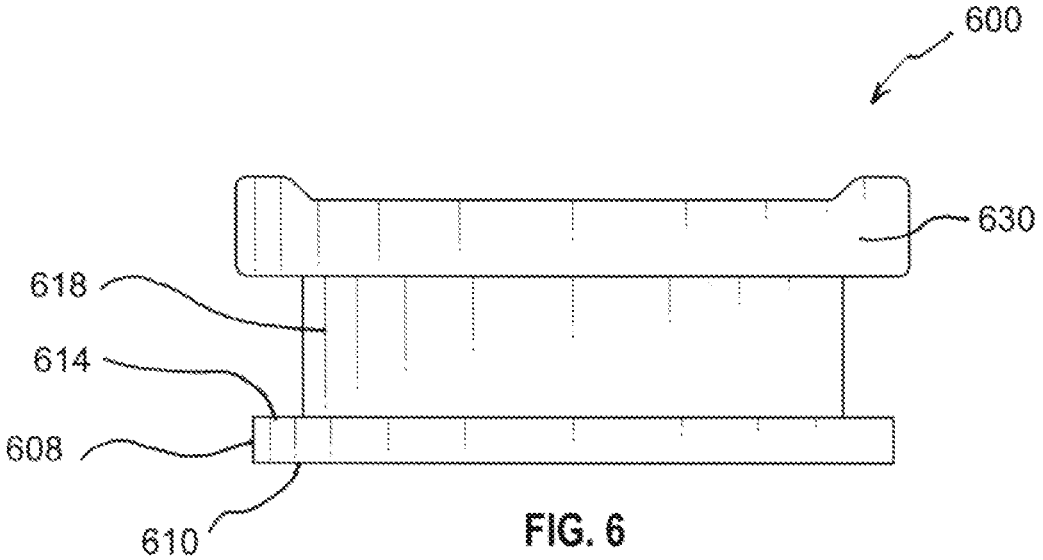
FIGS. 6, 7 and 8 illustrate another embodiment of an environmental seal according to the present inventions.
Figure 7:
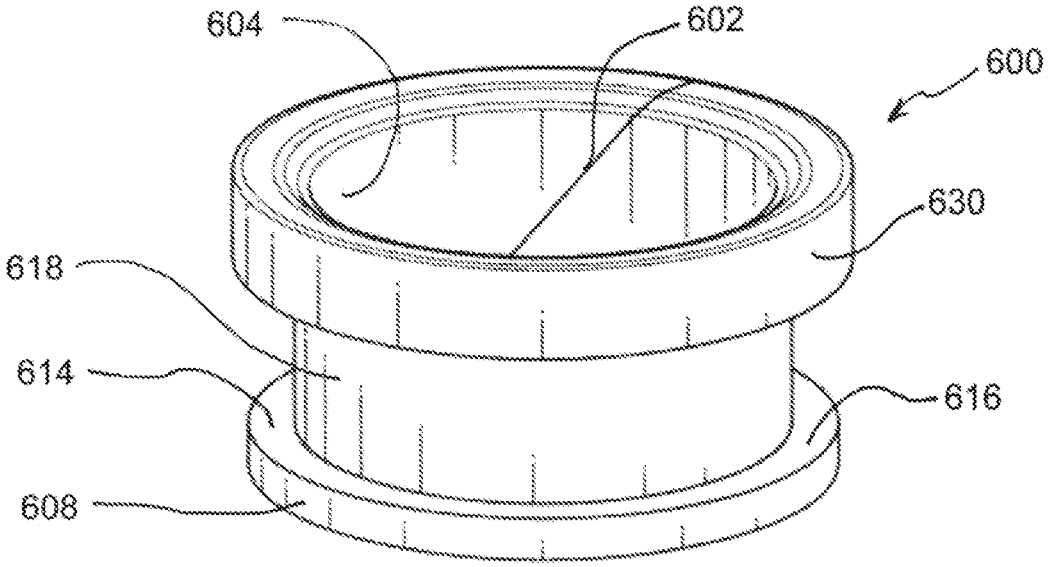
Figure 8:
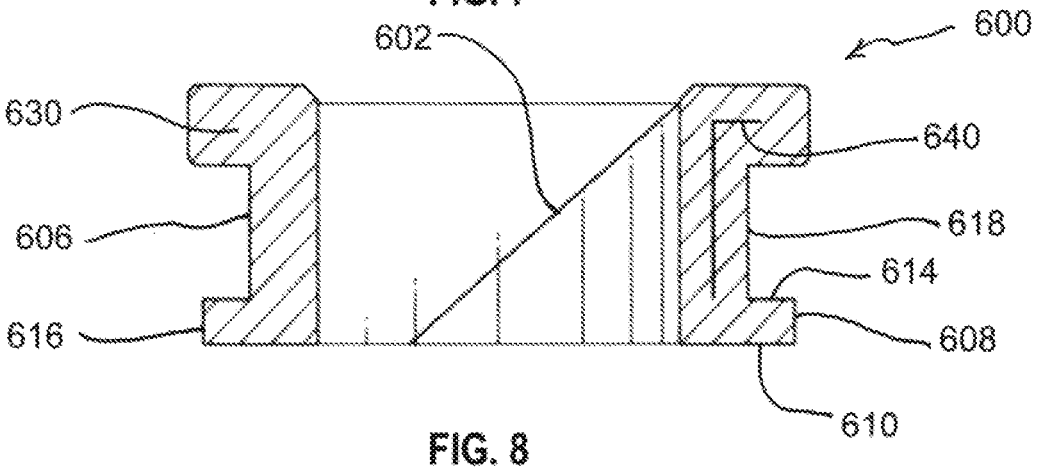

FIGS. 6-8 illustrate another of the many possible embodiments of the inventions disclosed and taught herein. Like the previously disclosed embodiments, this embodiment 600 may have a lip 608 and riser section 618, and a collar section 630 atop the riser section 618. The collar section 630 may have a flat top, or as shown in FIGS. 6-8, a series of concentric surfaces at different elevations.

Some operators may prefer this embodiment with a collar section 630 rather than having a taper section 220. In some situations, perhaps with a very rough or highly scored polished rod 102, more support may be desired around the upper portion of annular leak path seal 600 so that the polished rod 102 will slide without hinderance through annular leak path seal 600.

FIG. 8 illustrates seal 600 with an optional reinforcement 640. In this embodiment, optional reinforcement 640 may be any or more of the reinforcements previously discussed, or one or more angled rods, or a L-shaped flange made of a sheet or mesh, or any number of other embodiments that may be envisioned by those ordinarily skilled within the arts benefitting from the disclosures and teachings herein. While the optional reinforcement 640 is illustrated only on one side of the cross section in FIG. 8, those of skill will understand that the optional reinforcement 640 may be placed throughout seal 200. Also, although FIG. 8 shows the optional reinforcement 640 reinforcing the collar 630, the reinforcement 640 may reinforce the lip 608 instead. Additionally, the optional reinforcement 640 for this embodiment may be C-shaped to reinforce both the collar 630 and the lip 608.

Figure 9:
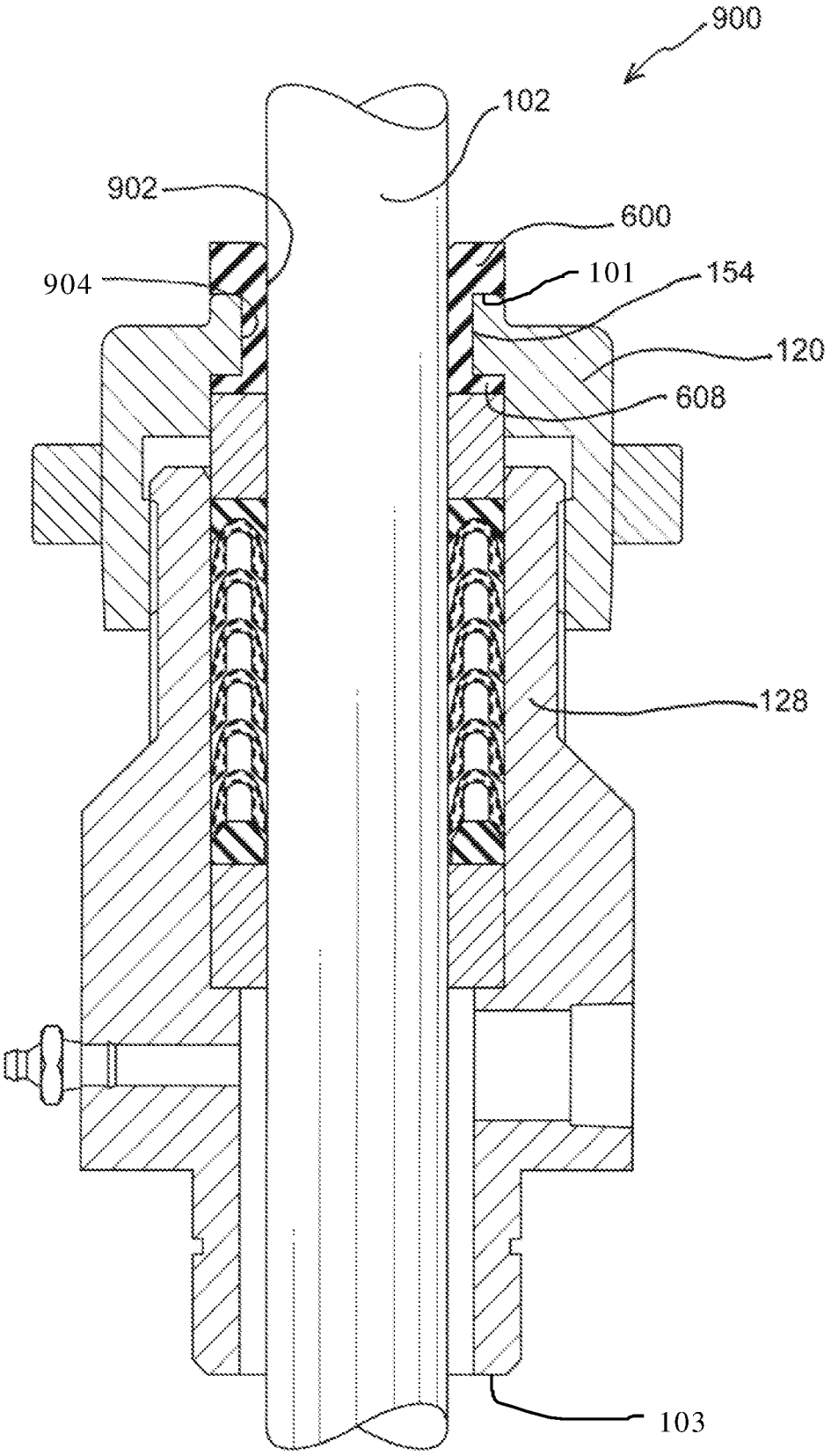
FIG. 9 illustrates a stuffing box with the environmental seal of FIG. 7.

The installation of annular leak path seal 600 may be performed in a manner similar to that previously discussed referring to the embodiment illustrated in FIGS. 2-5. However, in this embodiment, annular leak path seal 600 will have to be worked through stuffing box cap 120 so that the collar 630 and lip 608 will be above and below the opening as seen in FIG. 9. In one of many embodiments 900, collar 630 of annular leak path seal 600 may radially extend outwardly to about the same distance as the outside of the upper surface of stuffing box cap 120. In this embodiment 900 as well as in an embodiment where the collar 630 radially extends outwardly beyond the outside of the upper surface of stuffing box cap 120, any rain falling on the annular leak path seal 600 would drip outward past the upper annulus surface 154.

Like the embodiment illustrated in FIG. 5, the annular leak path seal 600 may be retained in the stuffing box 100 by the stuffing box cap 120 on the lip 608 of the annular leak path seal 600. In the embodiment in FIG. 9, the annular leak path seal 600 may be further retained by the interaction between the top of the stuffing box cap 120 and the collar 630 as they contact.

FIG. 9 illustrates how the embodiment 900 of the annular leak path seal 600 may be deployed in an exemplary stuffing box 100 having a top surface 101 and a bottom surface 103 in a manner like that disclosed above. In this embodiment, however, the annular leak path seal 600 will need to be worked into the space between the polished rod 102 and the inside of the stuffing box cap 120 before the stuffing box cap 120 is threaded on to the stuffing box body 128.

When deployed as is illustrated in FIG. 9, the annular leak path seal 600 may press tightly around the polished rod 102 to form an inner seal 902. The annular leak path seal 600 may also press tightly against the upper annulus surface 154 to form an outer seal 904. Having inner and outer seals 902, 904 will prevent fluids such as rain and condensate from entering the upper annulus and thus will prevent fluids from traveling downwards any further into the stuffing box 100.

Figure 10:
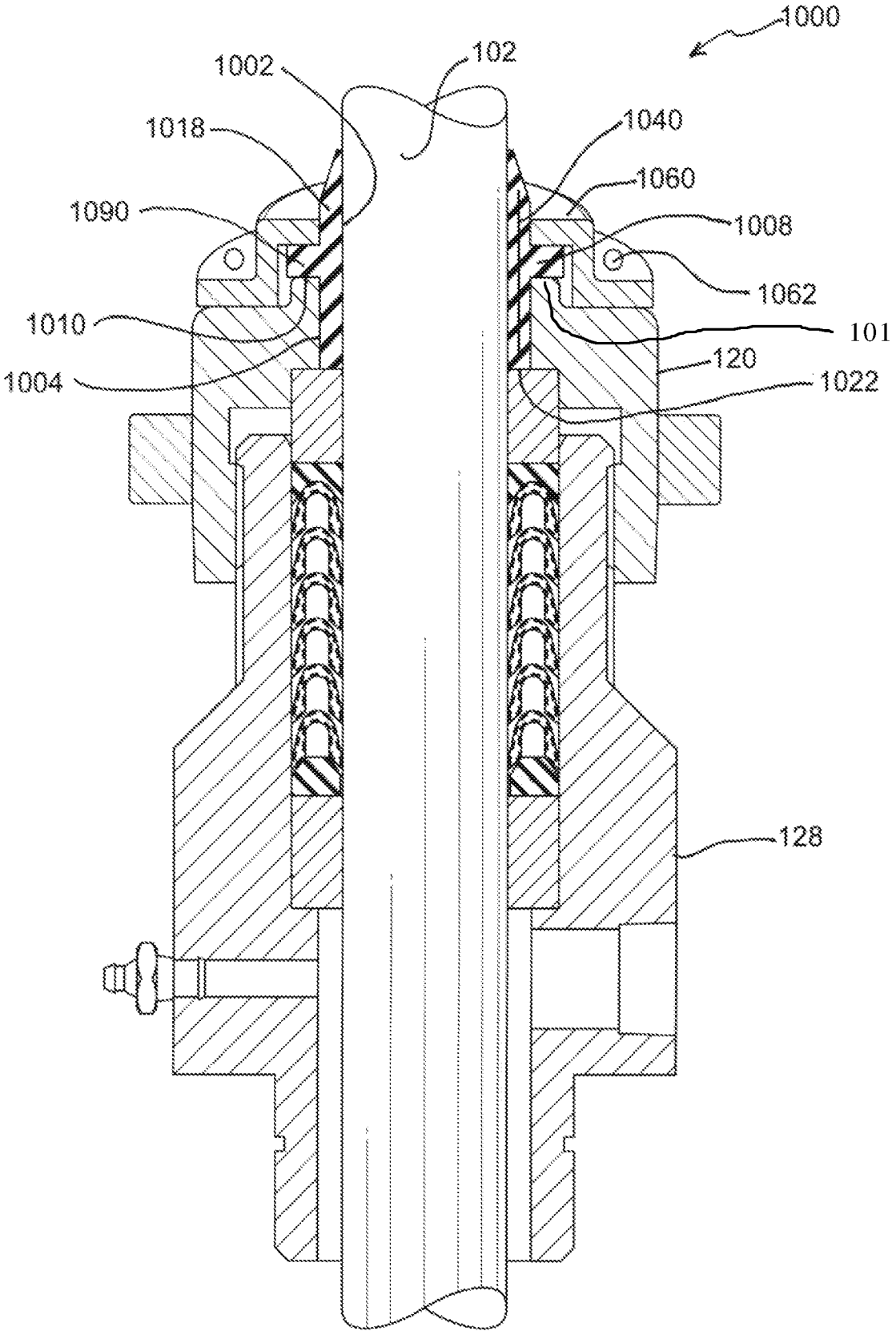
FIG. 10 illustrates another embodiment of an environmental seal incorporating an external hold down cap.

FIG. 10 illustrates another embodiment 1000 in which the stuffing box cap 120 does not need to be removed from the stuffing box body 128 to install annular leak path seal 1090. In this embodiment, annular leak path seal 1090 has a lip 1008 disposed along the riser section 1018, which is configured in such a way so that when the lower lip surface 1010 meets the top surface 101 of the stuffing box cap 120, the bottom 1022 of the annular leak path seal 1090 will press against the top of the upper packing bushing 122. An alternative to this embodiment may be configured such that the bottom 1022 of annular leak path seal 1090 may not touch the top of upper packing bushing 122 when the lower lip surface 1010 is in contact with the top of the stuffing box cap 120.

Annular leak path seal 1090 may be wrapped around polished rod 102 by opening annular leak path seal 1090 at its installation seam (not shown in this figure) and fitting it over the polished rod 102. The annular leak path seal 1090 may then be moved downward to the point where lower lip surface 1010 is in contact with the top of the stuffing box cap 120.

Annular leak path seal 1090 may be retained in this location relative to the stuffing box 100 using a hold down cap 1060. In one of many possible embodiments, hold down cap 1060 may be secured to the stuffing box 100 by securing the hold down cap 1060 to the stuffing box cap 120 using threaded fasteners inserted through fastener openings 1062. In other embodiments, hold down cap 1060 may be secured to the stuffing box 100 through any number of mechanisms known to those ordinarily skilled in the art.

As disclosed herein, apparatuses that are not contiguously cylindrical may be placed around the polished rod 102 without disassembling the pump jack, with minimal downtime. Thus, we have devised a hold down cap 1060 that may be comprised of multiple pieces or elements. For example, and not limitation, hold down cap 1060 may comprise two segmented pieces that may be put together around the polished rod 102. In one of many possible embodiments, this may be a split ring flange wherein the openings to join the two members are configured to align with the fastener openings 1062 in the stuffing box cap 120.

When deployed as is illustrated in FIG. 10, the annular leak path seal 1090 may press tightly around the polished rod 102 to form an inner seal 1002. The annular leak path seal 1090 may also press tightly against the upper annulus surface 154 to form an outer seal 1004. Having inner and outer seals 1002, 1004 will prevent external fluids such as rain from entering the upper annulus and thus will prevent fluids from traveling downwards any further into the stuffing box 100.

As may be seen in FIG. 10, an optional reinforcement 1040 may be formed or placed within the annular leak path seal 1090. The embodiment illustrated in FIG. 10 teaches that the optional reinforcement 1040 may comprise one or more rods. Those of ordinary skill in the art will realize that with the disclosures presented herein for the various embodiments, the optional reinforcement 1040 may be a series of rods or other structures as disclosed elsewhere herein. In one of many possible embodiments, the annular leak path seal 1090 may be manufactured with at least one or a plurality of optional reinforcement 1040 member or members. The optional reinforcement 1040 may also reinforce the lip 1008, as necessary or desired.

Optionally, the annular leak path seal 1090 may be manufactured as a solid body and an optional reinforcement 1040 member or members may be inserted through holes formed during the manufacturing process. Beyond manufacturing the holes in the body, the holes may also be formed by drilling into the annular leak path seal 1090 after the initial part is formed from a molding process.

If an optional reinforcement 1040 is inserted in a hole within the annular leak path seal 1090, the optional reinforcement 1040 may be inserted such that none of it extends beyond the annular leak path seal 1090 and it may or may not be sealed within the body of the annular leak path seal 1090. Alternatively, the optional reinforcement 1040 may extend to a surface of the annular leak path seal 1090. In the illustrated embodiment of FIG. 10, optional reinforcement 1040 may be formed or inserted into the annular leak path seal 1090 such that a portion of the optional reinforcement 1040 meets the top surface of upper packing bushing 122 such that it may thereby transfer some forces acting upon an upper portion of the annular leak path seal 1090 directly to the upper packing bushing 122.

In yet another embodiment, an optional reinforcement 1040 may be a threaded member. It may be screwed into a pilot hole formed in the annular leak path seal 1090 as described, or it may be screwed into the annular leak path seal 1090 without the use of a hole.

Figure 11:
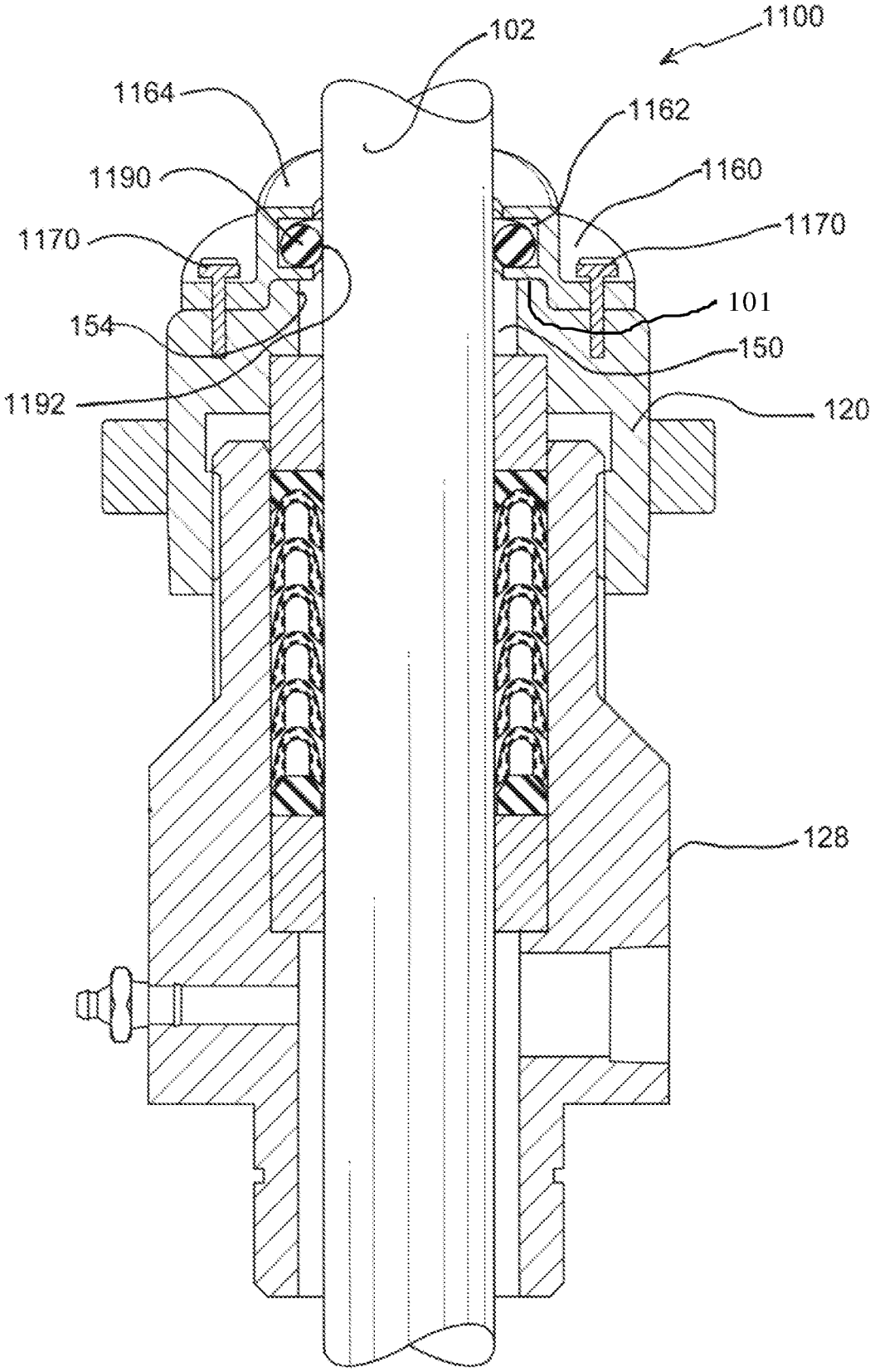
FIG. 11 illustrates another embodiment of an environmental seal incorporating an external seal housing.

FIG. 11 illustrates another possible embodiment 1100 of the present invention 10 where the annular leak path seal 1190 may comprise the shape of a torus retained within an annular chamber 1162 of seal housing 1160 that engages the top surface 101 of the stuffing box. This embodiment 1100 is similar to the embodiment of FIG. 10 in that the annular leak path seal 1190 and hold down housing 1160 may be installed without removing stuffing box cap 120 from the stuffing box body 128. Threaded members 1170 are shown in this illustration retaining hold down cap 1160 to stuffing box cap 120.

As illustrated in FIG. 11, hold down cap 1160 may have a top 1164 with a flat surface having an inside diameter less than the upper annulus surface 154 to restrict water or other fluids from entering upper annulus 150. Top 1164 may be angled away from the polished rod 102 such that water or condensate will naturally flow away from the hold down cap 1160.

Annular leak path seal 1190 may be in the form of an O-ring that has been cut to form an installation seam, as discussed previously. It may then be wrapped around polished rod 102 at a point above the stuffing box 100. The cut ends may be left as they are, or they may be bonded together as is disclosed elsewhere herein.

Hold down housing 1160 may be formed of multiple pieces as disclosed herein. In one embodiment, annular chamber 1162 may be configured to bias annular leak path seal 1190 towards the polished rod 102. Annular chamber 1162 may also compress the annular leak path seal 1190 to prevent rolling as polished rod 102 moves across it.

In an envisioned similar embodiment, the hold down cap may have a vertical space that is multiple times the diameter of a round annular leak path seal 1190. In this embodiment, the round leak path seal may be wound around the polished rod a number of times to the extent that it will fill the vertical space within the hold down cap. The hold down cap may then be configured to compress the coil of round annular leak path seal material in the vertical direction and/or in the radial direction such that the coil is pressed firmly against the shaft for the length of the coil.

In the embodiment 1100 illustrated in FIG. 11 and in the disclosed envisioned similar embodiment, the surface of the round annular leak path seal 1192 contacting the polished rod 102 may act as a wiper and a seal. This may allow any accumulated water that enters the annular chamber 1162 of hold down cap 1160 to remain there until it may evaporate. We envision that weep holes (not illustrated) may be formed through hold down cap 1160 to shunt any water that becomes trapped in annular chamber 1162 outside of the hold down cap 1160.

In an envisioned embodiment, hold down cap 1160 may be first attached to the stuffing box cap 120 with nothing in the annular chamber 1162. After the hold down cap 1160 is secure, a thermoset or thermoplastic substance may be injected into the annular channel 1162 and allowed to set. The polished rod 102 will be able to break away from the resulting hardened material when set in motion, but the resulting hardened material will be retained in the annular channel 1162 and will still affect a seal with the polished rod 102 so that no fluids will enter the upper annulus 150. The use of some thermoset or thermoplastic material may work better if the polished rod is first prepared with an antifriction substance such as, but not limited to, a spray-on non-stick dry-film material.

In a similar manner, an expanding foam material may be injected into annular chamber 1162 and allowed to set or harden. After setting or hardening, the expanded foam would separate from the polished rod 102 yet still provide a minimal area and some sealing to prevent fluids from entering the stuffing box 100. Although not illustrated in FIG. 11, persons of skill having benefit of his disclosure will now appreciate that seal 1192 optionally may include a reinforcement element.

Figure 12:
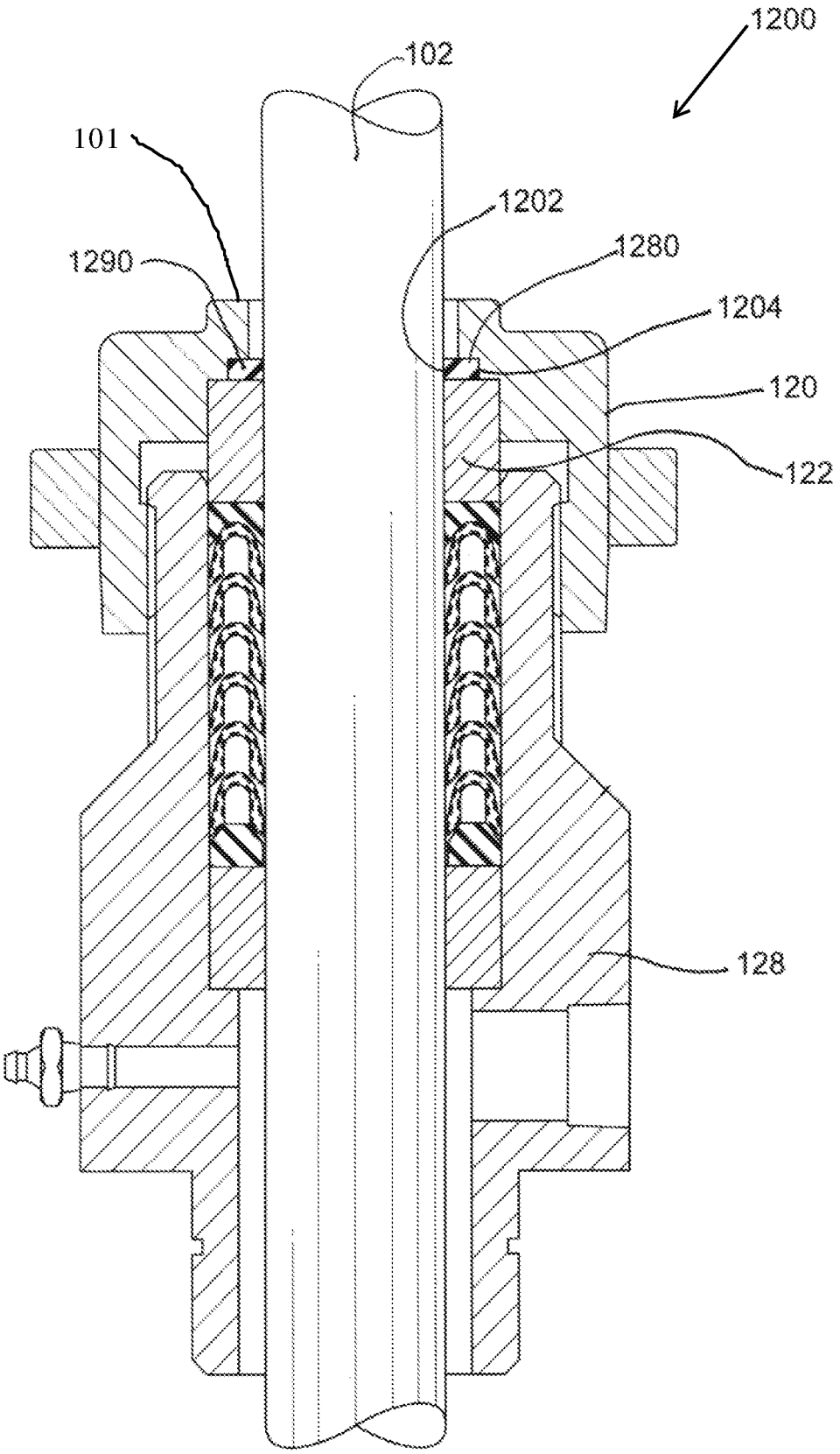
FIG. 12 illustrates another embodiment of an environmental seal for a modified stuffing box cap.

FIG. 12 illustrates another embodiment 1200 of the inventions disclosed and taught herein. In this embodiment 1200, annular leak path seal 1290 may be in a form similar to a split washer where the inside diameter of annular leak path seal 1290 is substantially the same as the diameter of the polished rod 102. Stuffing box cap 120, which defines top surface 101, has a rabbet 1280 cut from it to an elevation of about the height of the annular leak path seal 1290. This rabbet 1280 may be cut this way to still allow stuffing box cap 120 to directly contact upper packing bushing 122 and still retain annular leak path seal 1290 from movement or deformation from the reciprocating motion of the polished rod 102.

When deployed as illustrated in FIG. 12, annular leak path seal 1290 may form a seal 1202 against the polished rod 102, and a seal 1204 across the surfaces of the rabbet 1280.

While the rabbet 1280 shown in FIG. 12 has squared edges, other cross-sections may be envisioned by those in receipt of the inventions disclosed and taught herein including but not limited to angled, arcuate, semicircular, and curvilinear cross-sections and their combinations.

Figure 13:
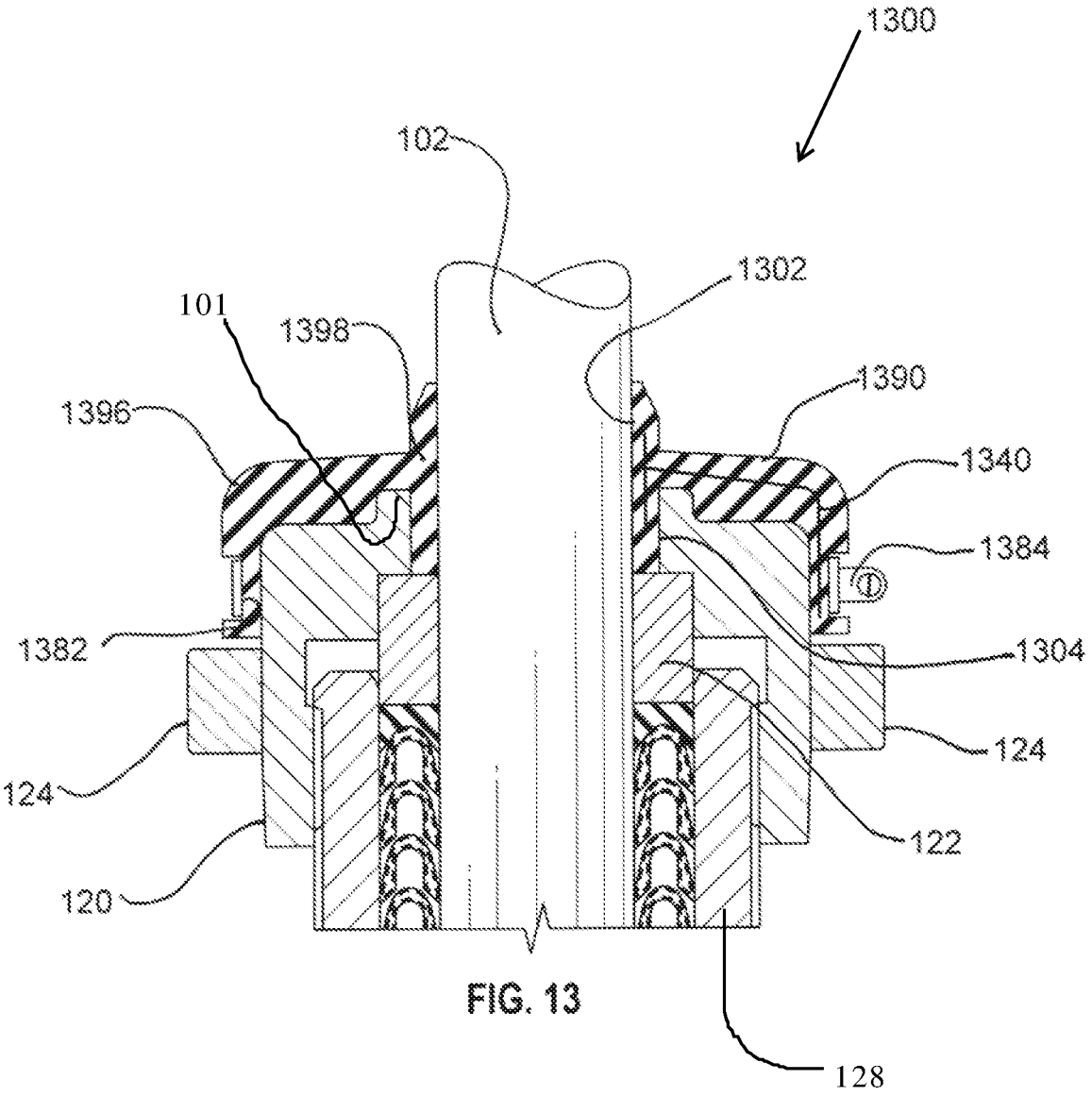
FIG. 13 illustrates another embodiment of an environmental seal for a stuffing box.

FIG. 13 illustrates an embodiment 1300 where annular leak path seal 1390 overlays the top surface 101 of stuffing box 100. The innermost portion of annular leak path seal 1390 may have a form like any embodiments disclosed or illustrated herein, and also comprises a shroud portion 1396. This exemplary embodiment allows for the annular leak path seal 1390 to be placed over the stuffing box 100 without removing the stuffing box cap 120.

The installation of annular leak path seal 1390 may be done in a manner similar to installing other embodiments of an annular leak path seal as described and taught herein. The installation seam (not illustrated in this figure) may be pulled apart far enough to allow some part of the annular leak path seal 1390 to be fitted over the polished rod 102. The remainder of the annular leak path seal 1390 may then be worked so that the entirety of the inside 1302 of annular leak path seal 1390 is wrapped around the polished rod 102. The annular leak path seal 1390 may then be worked downwards so that the bottom areas of annular leak path seal 1390 are pressed against the stuffing box cap 120. The lower portion of the toroid 1398 will be pushed into upper annulus 150. The bottom of the lower portion 1398 may or may not touch the top of upper packing bushing 122.

When deployed as is illustrated in FIG. 13, the annular leak path seal 1390 may press tightly around the polished rod 102 to form an inner seal 1302. The annular leak path seal 1390 may also press tightly against the upper annulus surface 154 to form an outer seal 1304. Having inner and outer seals 1302 1304 will prevent fluids such as rain and condensate from entering the upper annulus and thus will prevent fluids from traveling downwards any further into the stuffing box 100. Also, the shroud portion 1396 will further prevent any fluids from entering stuffing box 100 by providing an umbrella-like cover over the entire stuffing box 100.

Optional reinforcements 1340 may be placed into annular leak path seal 1390 as has been disclosed elsewhere herein. In this embodiment, as well as in all embodiments disclosed herein, the optional reinforcements 1340 may be multi-legged and/or of complex arrangements of parts. In FIG. 13, optional reinforcement 1340 has one leg running axially within annular leak path seal 1390 from the lower portion 1398 upwards, and another leg running outward through the shroud portion 1396.

Annular leak path seal 1390 may be retained onto stuffing box 100 through any number of ways known to those ordinarily skilled in the art. In one method, groove 1382 may be used to peripherally compress annular leak path seal 1390 around stuffing box cap 120. The compressive force may be from any number of sources including but not limited to springs, clasps, hasps, crimped bands, threaded members going through the shroud portion 1396 and other means known to those skilled in the art. The method illustrated in FIG. 13 is the use of a worm gear clamp 1384. Worm gear clamp 1384 may be opened to wrap around the polished rod 102 and the installed annular leak path seal 1390 in groove 1382. The worm gear clamp 1384 may then be tightened to secure annular leak path seal 1390 around stuffing box cap 120. Other means that may be used to secure annular leak path seal 1390 to the stuffing box 100 may include the use of sealants or glue, or other mechanical retaining mechanisms known to those of skill in the art including using the tightening lug 124.

The embodiments of the inventions disclosed and taught herein have heretofore been described as having a uniform composition of a material such as, but not limited to, neoprene. However, the embodiments disclosed herein are not limited to having a uniform composition. In one of many possible embodiments that may allow one of ordinary skill in the art to practice the inventions disclosed and taught herein, an embodiment of an annular leak path seal may be composed of an outer layer of neoprene covering an inner skeleton of a different material. This embodiment may allow a material with a desired stiffness to be used inside the annular leak path seal, but that may have undesirable surface properties that do not lend themselves well to constant contact and reciprocating motion of a polished rod. Therefore, coating that stiff material with a material that has less desirable stiffness properties, but is more amenable to the constant contact and reciprocating motion of a polished rod may produce a more desirable embodiment.

In yet another embodiment of the inventions disclosed and taught herein, the interior of an annular leak path seal may be hollow and fillable through a valve. An annular leak path seal may be installed as disclosed herein while deflated, and then inflated with air or other suitable medium to have an internal pressure sufficient to affect and maintain seals as disclosed herein. To aid in oilfield automation, the pressure may be remotely monitored by a system like an automated tire pressure monitoring system and an operator alerted if the pressure falls outside of a desired range. If further desired, the pressure may be maintained by systems that automatically inflate or deflate tires and the like that are known to those ordinarily skilled in the art. In another envisioned embodiment, the annular leak path seal may be inflated to affect seals when weather conditions indicate that rain may fall or condensate may accumulate, but otherwise the annular leak path seal may be deflated in such a way that it will pull away from the polished rod to reduce wear.

Having now disclosed multiple different embodiments of our inventions, persons of skill in this art will appreciate that other and further embodiments utilizing one or more aspects of the inventions described above can be devised without departing from the spirit of our invention. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by us, but rather, in conformity with the patent laws, we intend to protect fully all such modifications and improvements that come within the literal scope or range of equivalents of the following claims. The words, terms, and phrases used in the following claims are intended to have the meaning or meanings that are ordinary and customary in this art. Unless explicitly identified as such, we have not intended to define a word, term, or phrase in this application.

What is claimed is:

1. A stuffing box seal for a polished rod stuffing box, the stuffing box having a length defined between a bottom surface and a top surface of a stuffing box cap and having a packing gland seal disposed between the bottom surface and the top surface of the stuffing box cap, the stuffing box seal comprising:

an elongated toroid made of an elastically deformable material having an inside, an outside, a thickness, and a length;

the outside of the elongated toroid having at least one lip extending radially from the outside of the elongated toroid for at least a portion of the length of the elongated toroid;

wherein the lip is retained against a surface within the stuffing box while a portion of the stuffing box seal extends outside of the stuffing box beyond the top surface of the stuffing box cap;

the elongated toroid comprising a slit through the thickness of the elongated toroid along its length, and wherein the slit has a first face and a second face, the slit allowing the seal to be disposed about a rod by opening the slit about the rod; and wherein at least a portion of the inside of the elongated toroid forms a seal with the polished rod above the top surface of the stuffing box cap when the first face of the slit abuts the second face of the slit.

2. The seal of claim 1 wherein a portion of the outside of the elongated toroid is configured to form a seal with at least a portion of an annular surface within the stuffing box.

3. The seal of claim 1 wherein the lip is disposed adjacent to a first end of the elongated toroid.

4. The seal of claim 1 wherein the lip is disposed between a first end and a second end of the elongated toroid.

5. The seal of claim 1 wherein the lip is releasably retained against a second surface.

6. The seal of claim 5 wherein the second surface is a surface of the stuffing box apart from the first surface.

7. The seal of claim 5 wherein the second surface is secured to the stuffing box.

8. The seal of claim 7 wherein the second surface is secured to the stuffing box with threaded members.

9. The seal of claim 1 wherein the polished rod reciprocates within the elongated toroid seal.

10. A stuffing box seal for a stuffing box having a cap with a top surface and a packing seal disposed within the stuffing box below the cap, comprising:

a body having an inside, an outside, an inside diameter surface, an outside diameter surface, and a length;

the outside diameter surface of the body having at least one radially projecting lip extending perpendicular from and along at least a portion of the length of the body;

wherein the at least one radially projecting lip has an upper surface and a lower surface and wherein at least the lower surface engages a surface of a stuffing box to constrain movement of the stuffing box seal relative to the stuffing box;

a separation in the body from the inside diameter to the outside diameter along the length of the body;

the separation having a first face and a second face wherein each face is a surface extending radially from at least the inside diameter surface to the outside diameter surface of the body along the length of the body;

the body openable along the separation such that the first face of the separation is at a distance at least equal to the inside diameter of the body away from the second face of the separation;

wherein a first portion of the body extends outwardly from the top surface of the stuffing box cap and the inside diameter surface of the first portion of the body forms a seal with a shaft above the top surface of the stuffing box cap, the shaft having a diameter substantially the same as the inside diameter of the body.

11. The stuffing box seal of claim 10 wherein at least a portion of the outside diameter surface of the body is configured to form a seal with an annular surface within the stuffing box having an inside diameter substantially the same as the outside diameter of the body.

12. The stuffing box seal of claim 10 wherein the lip is disposed adjacent to a first end of the body.

13. The stuffing box seal of claim 10 wherein the lip is disposed between the first end and a second end of the body.

14. The stuffing box seal of claim 10 wherein the lip is releasably retained against a second surface.

15. The stuffing box seal of claim 14 wherein the second surface is a surface of the stuffing box apart from the first surface.

16. The stuffing box seal of claim 14 wherein the second surface is secured to the stuffing box.

17. The stuffing box seal of claim 16 wherein the second surface is secured to the stuffing box with threaded members.

18. The stuffing box seal of claim 10 wherein the shaft is configured for reciprocating motion within the body.

19. A method for installing a sealing element on a stuffing box comprising:

providing a stuffing box having a cap with a top surface, a packing gland seal disposed within the stuffing box below the top surface, and the stuffing box encompassing a rod;

providing a sealing element comprising a body made of an elastically deformable material having an inside, an outside, a thickness, and a length;

the outside of the body of the sealing element having at least one lip extending radially away from the outside of the body for at least a portion of the length of the body;

the lip comprising at least one surface normal to a central axis of the body;

the body having a seam through the thickness of the body along its length, and wherein the seam has a first face and a second face; and wherein the inside of the body of the sealing element seals against at least a portion of the rod;

opening at least a portion of the seam to a width of at least the diameter of the rod;

placing the open portion of the seam on the rod and moving the body towards the rod until the body opposite the seam touches the rod;

closing the seam; and axially moving the body along the shaft until a first portion of the body is disposed within the stuffing box below the top surface of the cap and the surface of the lip seals against a surface of the stuffing box and a second portion of the body extends above the top surface of the cap and seals along the rod outside of the stuffing box.

20. The method of claim 19 further comprising removing and replacing a stuffing box cap.

* * * * *